United States Patent [19]

Baron et al.

[11] 4,418,747

[45] Dec. 6, 1983

[54] SHUTTLE CLEANING OF HEAT EXCHANGER TUBES

[75] Inventors: Walter J. Baron; Laird C. Cleaver, both of Milwaukee, Wis.

[73] Assignee: Water Services of America, Inc., Milwaukee, Wis.

[21] Appl. No.: 348,742

[22] Filed: Feb. 16, 1982

[51] Int. Cl.[3] ..... F28F 5/00

[52] U.S. Cl. ..... 165/95; 166/153; 166/170; 15/104.06 A; 134/8; 134/22.11

[58] Field of Search ..... 166/153, 156, 170; 165/95; 15/104.06 R, 104.06 A; 134/8, 22.11

[56] References Cited

U.S. PATENT DOCUMENTS

| | | | |
|---|---|---|---|
| 323,972 | 8/1885 | Sweeney | 15/104.06 R |
| 810,632 | 1/1906 | Faherty et al. | 122/379 |
| 1,218,005 | 3/1917 | Schlemmer | 15/104.16 |
| 1,248,847 | 12/1917 | Griffin | 15/104.06 R |
| 1,280,443 | 10/1918 | Griffin | 15/104.06 R |
| 1,424,336 | 8/1922 | Bowman | 15/104.06 |
| 1,673,890 | 6/1928 | Smith | 15/104.06 |
| 1,886,419 | 11/1932 | Oberhuber | 15/104.06 |
| 2,055,287 | 9/1936 | Giraud | 15/104.06 |
| 2,506,530 | 5/1950 | Westerman et al. | 166/18 |
| 2,810,143 | 10/1957 | Reynolds | 15/104.06 |
| 3,074,436 | 1/1963 | En Dean | 137/802 |
| 3,319,710 | 5/1967 | Heeren et al. | 165/95 |
| 3,460,180 | 8/1969 | Girard | 15/104.06 |
| 3,484,886 | 12/1969 | Girard | 15/104.06 |
| 3,691,584 | 9/1972 | Landers | 15/104.06 |
| 3,747,479 | 10/1973 | Girard | 15/104.06 |
| 4,124,065 | 11/1978 | Leitner et al. | 165/95 |

*Primary Examiner*—William R. Cline
*Assistant Examiner*—Theophil W. Streule
*Attorney, Agent, or Firm*—Andrus, Sceales, Starke & Sawall

[57] ABSTRACT

A shuttle assembly is provided which includes a spring cleaning element secured at each end to mounting members which are freely slideable on a longitudinal axial rod. The rod is longer than the cleaning element in its normal extended position so that the cleaning element can shuttle back and forth on the rod. Stop members are secured to the end portions of the rod. When either rod end engages a capturing device at the end of a heat exchanger tube, inertia causes the cleaning element to slide forwardly until the adjacent mounting member tappingly engages the adjacent stop member of the assembly, causng undesirable material on the cleaning element to drop off. The mounting members are of a lesser O.D. (Outside Diameter) than the I.D. (Inside Diameter) of the pipe and are also of a lesser O.D. than the O.D. of the normally extended cleaning element. The O.D. of the cleaning element is such as to allow for transverse rattling engagement with the inner tube wall during shuttling.

9 Claims, 5 Drawing Figures

SHUTTLE CLEANING OF HEAT EXCHANGER TUBES

U.S. PRIOR ART OF INTEREST

| U.S. Pat. No. | Inventor | Issued |
|---|---|---|
| 323,972 | Sweeney | Aug. 11, 1885 |
| 810,632 | Faherty et al. | Jan. 23, 1906 |
| 1,218,005 | Schlemmer | Mar. 6, 1917 |
| 1,248,847 | Griffin | Dec. 4, 1917 |
| 1,280,443 | Griffin | Oct. 1, 1918 |
| 1,424,336 | Bowman | Aug. 1, 1922 |
| 1,673,890 | Smith | Jun. 19, 1928 |
| 1,886,419 | Oberhuber | Nov. 8, 1932 |
| 2,055,287 | Giraud | Sep. 22, 1936 |
| 2,506,530 | Westerman et al. | May 2, 1950 |
| 2,810,143 | Reynolds | Oct. 22, 1957 |
| 3,074,436 | En Dean | Jan. 22, 1963 |
| 3,319,710 | Heeren et al. | May 16, 1967 |
| 3,460,180 | Girard | Aug. 12, 1969 |
| 3,747,479 | Girard | Oct. 28, 1969 |
| 3,484,886 | Girard | Dec. 23, 1969 |
| 3,691,584 | Landers | Sep. 19, 1972 |
| 4,124,065 | Leitner et al. | Nov. 7, 1978 |

BACKGROUND AND SUMMARY OF THE INVENTION

This invention relates to shuttle cleaning of heat exchanger tubes and is an improvement over the concepts disclosed in the above-identified patents.

It is known from U.S. Pat. Nos. 3,319,710 and 4,124,065 to connect individual elongated cleaning element capturing cages or baskets to both ends of longitudinally extending tubes disposed in a heat exchanger housing. The tube ends are held in position at both ends by transverse tube sheets. The baskets are adapted to contain shuttlable cleaning elements, such as brushes. Fluid flowing in one direction through the tubes keeps the cleaning elements captured within their respective basket chambers, while the fluid discharges outwardly through slot-like openings in the basket walls. Upon reversal of fluid flow, the cleaning elements are forced out of their baskets and through the tubes to the baskets at the opposite tube ends to thereby perform a tube cleaning action.

In low temperature applications, brushes and baskets are often made of plastic materials. In high temperature situations, such as in the cracking of crude oil, plastic may not be suitable and metal elements may be needed.

Broadly, it is known to use coiled metal springs as cleaning elements for pipe lines. See, for example, U.S. Pat. Nos. 3,460,180 and 3,474,479. In addition, it is known from these two patents to provide a coiled metal cleaning element having members on each end which sealingly engage the pipe walls. It is also known to mount a cleaning element on a central shaft, such as in U.S. Pat. Nos. 2,506,530 and 3,484,886.

It is a task of the present invention to provide an improved cleaning arrangement for heat exchanger tubing wherein a shuttling tube cleaning means is utilized which is automatically self-cleaning adjacent both ends of the tube.

It is a further task of the invention to utilize the forces of inertia to assist in removing built up undesirable material on the shuttlable cleaning element.

It is another task of the invention to provide a spring tube cleaning means which is free along its entire length to move transversely of the pipe during shuttling to improve the cleaning action.

In accordance with the various aspects of the invention, a shuttle assembly is provided which includes a spring cleaning element secured at each end to mounting members which are freely slideable on a longitudinal axial rod. The rod is longer than the cleaning element in its normal extended position so that the cleaning element can shuttle back and forth on the rod. Stop members are secured to the end portions of the rod. When either rod end engages a capturing device at the end of a heat exchanger tube, inertia causes the cleaning element to slide forwardly until the adjacent mounting member tappingly engages the adjacent stop member of the assembly, causing undesirable material on the cleaning element to drop off.

The mounting members are of a lesser O.D. (Outside Diameter) than the I.D. (Inside Diameter) of the pipe to permit fluid to pass through the assembly during shuttling. The mounting members are also of a lesser O.D. than the O.D. of the normally extended cleaning element.

The O.D. of the cleaning element is such as to allow for transverse rattling engagement with the inner tube wall during shuttling.

BRIEF DESCRIPTION OF THE DRAWINGS

The accompanying drawings illustrate the best mode presently contemplated by the inventors for carrying out the invention.

In the drawings.

DESCRIPTION OF THE PREFERRED EMBODIMENT

Figure 1:
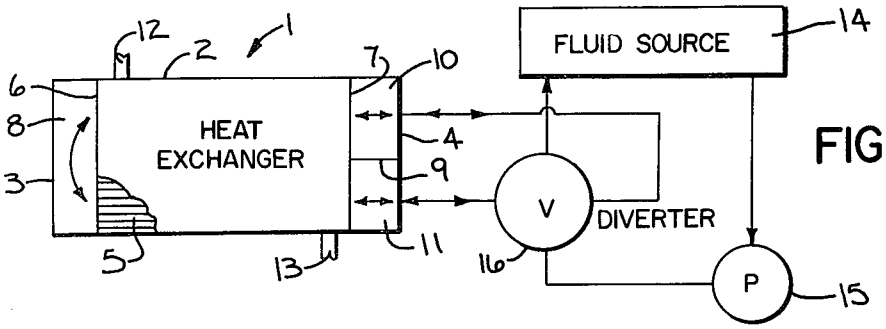
FIG. 1 is a schematic showing of a heat exchanger and fluid flow controls thereof.
Figure 4:
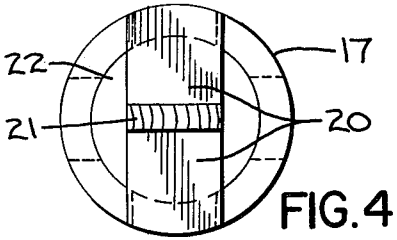
FIG. 4 is an end view of one of the capturing devices.

The present invention is directed to tube-type heat exchangers. A schematic showing of such an exchanger and its fluid flow controls is shown in FIG. 1. The exchanger 1 comprises a cylindrical housing 2 having end closure heads 3 and 4, and a plurality of longitudinally extending tubes 5 therein. The exposed open ends of tubes 5 are connected to transverse tube sheets 6 and 7 which are spaced from the respective end heads 3 and 4. Head 3 and tube sheet 6 form one fluid flow chamber 8, while a partition 9 separates the space between head 4 and tube sheet 7 into a pair of fluid flow chambers 10 and 11. Heat exchanging fluid is introduced through an inlet 12 to the area around tubes 5 and discharges through an outlet 13.

Heat exchanger 1 is also connected to a fluid source 14, a pump 15 and a fluid diverter valve 16 by various conduits in the conventional manner. Fluid is directed through tubes 5 via chambers 10, 8 and 11, in that order or in reverse order, depending on the position of valve 16.

Heat exchanger 1 is provided with tube cleaning means. For this purpose, the end of each tube 5 is connected to a capturing device which in the present embodiment comprises a longitudinally extending elongated slotted basket 17 which is coaxial with the tube and preferably made of metal. The inner end of each basket is threadably secured to an opening 18 in tube plate 6 or 7 and abuts the flared outer tube end 19 which is press fit into the opening. The I.D.'s of tubes 5 and baskets 17 are the same. The outer end of each basket 17 is provided with a pair of narrow tabs 20 which are folded over and joined, as by a weld 21, to form an abutment.

Each basket forms a capturing chamber 22 for holding a shuttle assembly 23 which is adapted to move back and forth between end baskets within its respective tube 5 upon reversal of fluid flow by valve 16.

Each shuttle assembly 23 is shown as comprising a tube cleaning element formed in this instance as a longitudinally extending helical coil spring 24, the ends of which are suitably secured to a pair of longitudinally spaced mounting members shown as transversely extending rigid planular circumferential discs 25. Discs 25 are provided with central openings which receive a rod 26 therethrough for free sliding movement of the discs thereon. Rod 26 is coaxial with and longer than the normal extended length of spring 24, and is provided with stop means at each end, shown in this embodiment as transversely extending rigid planular circumferential discs 27 welded to the rods as at 28.

Figure 2:
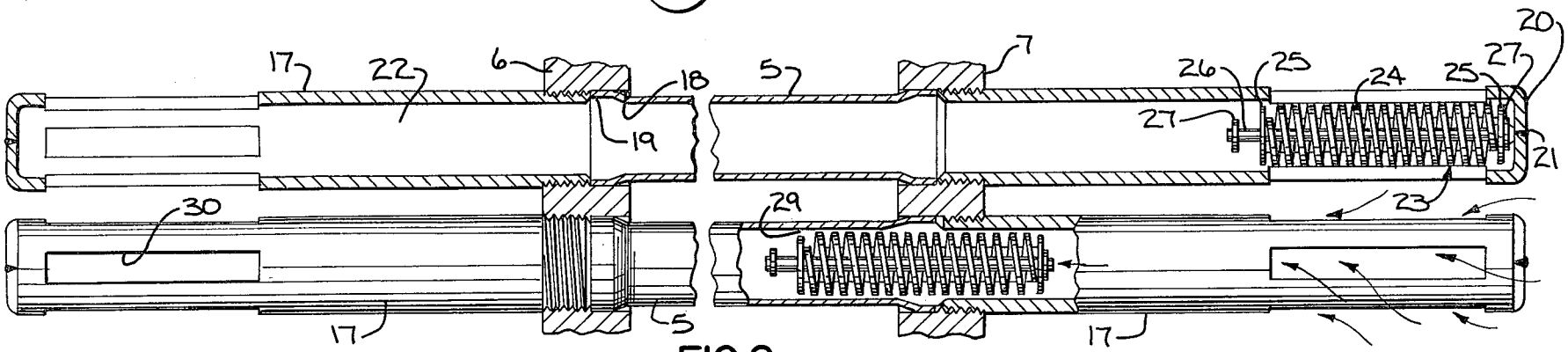
FIG. 2 is an enlarged fragmentary longitudinal side view through a portion of the heat exchanger showing two tubes with shuttle assemblies in different positions and with parts broken away and in section.

As shown in connection with the lower tube 5 of FIG. 2, discs 27 are about one-half the diameter of discs 25. Furthermore, discs 25 are of lesser diameter than the I.D. of tubes 5 to thereby provide a longitudinal fluid flow passage 29 therebetween and thus through the assembly. Discs 25 are also of lesser diameter than that of the normally extended spring 24. In addition, the diameter of spring 24 is less than the I.D. of tube 5. The same relationships apply relative to baskets 17, as seen in FIG. 3.

For purposes of illustration, the right end basket 17 of upper tube 5 in FIG. 2 is shown as having a shuttle assembly 23 captured therein. Spring 24 is disposed at the right end of rod 26 with discs 25 and 27 in engagement. Upon reversal of fluid flow leftwardly within the heat exchanger, (see the arrows in the lower part of FIG. 2) assembly 23 moves leftwardly into and through tube 5. Since there is substantially less frictional contact area between rod 26 and the free sliding discs 25 than that between spring 24 and tube 5, the leftward moving fluid engaging the outer fluid bearing surface of disc 27 will biasingly maintain rod 26 in a downstream position relative to spring 24. Furthermore, fluid can bypass both discs 25 through passages 29. At the same time, and due to the above described diametrical relationship between tube 5 and spring 24, the latter can move transversely relative to the tube in a rattling action as it moves along. This supplements the spring's normal scraping action by causing vibrations to assist in removal of deposits from the tube walls. During leftward movement of assembly 23, the deposits removed are generally confined to the area between discs 25, being either attached to spring 24 or in the fluid surrounding it, within the assembly.

Figure 3B:
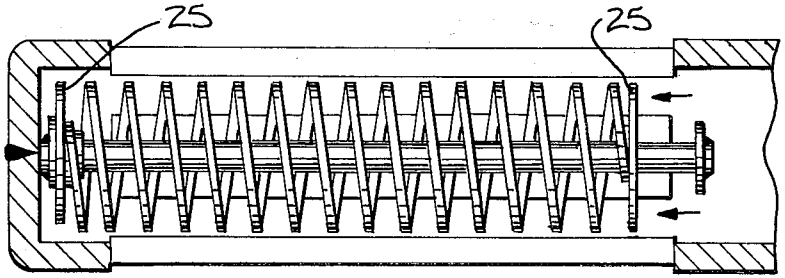
FIGS. 3A and 3B are enlarged fragmentary longitudinal sections showing the action of the tube cleaning assembly upon engagement with an end capturing device.
Figure 3A:
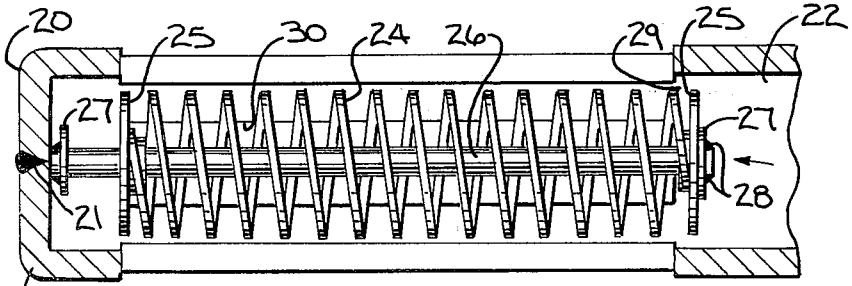

Turning now to FIG. 3A, shuttle assembly 23 finally enters left basket 17 and proceeds until the forwardly exposed downstream end of rod 26 tappingly engages the abutment formed by tabs 20. This will apply a minor shock to spring 24 which may tend to loosen some material which has accumulated on the spring. However, as shown in FIG. 3B inertia will cause spring 24 to now freely shift forwardly on rod 26 until forward disc 25 tappingly engages the stop formed by the inner face of forward disc 27. A supplemental shock will thus be applied to spring 24 to further loosen any undesired accumulated material therefrom. Continued fluid flow will now carry the undesired loosened material out through slots 30 in basket 17.

When the fluid flow is reversed, the action and movement of assembly 23 is also reversed from that described above.

The concepts of the invention provide a cleaning assembly which not only selectively shuttles back and forth within heat exchanger tubing, but which also includes a combination of elements which shuttle within the assembly itself. Not only is the tubing cleaned, but the shuttle is also cleaned automatically at the end of each pass.

Various modes of carrying out the invention are contemplated as being within the scope of the following claims particularly pointing out and distinctly claiming the subject matter which is regarded as the invention.

We claim:

1. For use in cleaning a heat exchanger tube adapted to have a fluid reversably flowable therethrough and having capturing devices disposed at each end, and with said capturing devices having abutments thereon, a shuttle assembly for making back-and-forth passes through said tube between said capturing devices in response to fluid flow, said shuttle assembly comprising:

(a) a spring tube cleaning element, (b) a pair of rigid longitudinally spaced mounting members secured to said spring, (c) a rod disposed coaxially with and longer than said spring and with said rod having said mounting members and said spring freely shiftable thereon, (d) and stop members disposed at each end of said rod, (e) the ends of said rod being adapted to engage the abutments of said capturing devices when said shuttle assembly reaches the ends of said tubes so that said spring and mounting members freely shift on said rod until one of said mounting members engages one of said stop members.

2. The shuttle assembly of claim 1 in which:

(a) the said ends of said rod are adapted to engaged the said capturing device abutments to thereby apply a first shock to said spring when said assembly reaches the end of a pass through the tube, (b) and said mounting members are adapted to engage said stop members to thereby apply a second shock to said spring subsequent to free shifting movement thereof, (c) said first and second shocks assisting in removal of material accumulated on said spring during a pass through the tube.

3. The shuttle assembly of claim 1 or 2 in which said spring comprises tube cleaning means shuttlable on said rod during back-and-forth movement of said assembly.

4. The shuttle assembly of claim 1 in which said mounting members are circumferential and of lesser diameter than said spring.

5. The shuttle assembly of claim 4 in which said mounting members and said heat exchanger tube form a longitudinal fluid flow passage through the assembly.

6. The shuttle assembly of claim 1, 4 or 5 in which said stop members are circumferential and of lesser diameter than said mounting members.

7. The shuttle assembly of claim 6 in which said stop members provide:

(a) an outer fluid bearing surface for biasing said rod in a direction downstream relative to said spring during passage of said assembly through the tube, (b) and an inner stop surface for engagement by said mounting members.

8. The shuttle assembly of claim 1, 4 or 5 wherein said mounting members provide means to confine material removed from the pipe by said spring to within the assembly.

9. The shuttle assembly of claim 1, 4 or 5 in which said spring comprises means for transverse rattlingly engaging the wall of the tube during passage of said assembly therethrough.

* * * * *